US008539520B2

(12) United States Patent
Falcon

(10) Patent No.: US 8,539,520 B2
(45) Date of Patent: Sep. 17, 2013

(54) AUDIENCE MEASUREMENT APPARATUS, SYSTEM AND METHOD

(75) Inventor: Fernando D. Falcon, Milan (IT)

(73) Assignee: The Nielsen Company (US), LLC, Schaumburg, IL (US)

( * ) Notice: Subject to any disclaimer, the term of this patent is extended or adjusted under 35 U.S.C. 154(b) by 841 days.

(21) Appl. No.: 12/623,143

(22) Filed: Nov. 20, 2009

(65) Prior Publication Data

US 2010/0131970 A1 May 27, 2010

(30) Foreign Application Priority Data

Nov. 21, 2008 (GB) ..... 0821364.7

(51) Int. Cl.
*H04H 60/32* (2008.01)
*H04H 60/33* (2008.01)
*H04H 20/14* (2008.01)

(52) U.S. Cl.
USPC ..... 725/19; 725/9; 725/15; 725/22

(58) Field of Classification Search
None
See application file for complete search history.

(56) References Cited

U.S. PATENT DOCUMENTS

| | | | | |
|---|---|---|---|---|
| 4,677,466 | A * | 6/1987 | Lert et al. | 725/22 |
| 7,836,474 | B2 * | 11/2010 | Son et al. | 725/87 |
| 2004/0093394 | A1 * | 5/2004 | Weber et al. | 709/219 |
| 2004/0226035 | A1 * | 11/2004 | Hauser, Jr. | 725/9 |
| 2006/0195857 | A1 * | 8/2006 | Wheeler et al. | 725/15 |

FOREIGN PATENT DOCUMENTS

| | | |
|---|---|---|
| EP | 1043854 | 10/2000 |
| WO | WO8606239 | 10/1986 |
| WO | WO9832251 | 7/1998 |
| WO | WO0079709 | 12/2000 |
| WO | WO03026169 | 3/2003 |
| WO | WO2005006768 | 1/2005 |
| WO | WO2005079499 | 9/2005 |

OTHER PUBLICATIONS

International Searching Authority, "International Search Report," issued in connection with International Application Serial No. PCT/IB2009/007436, mailed Mar. 29, 2010, 4 pages.

International Searching Authority, "Written Opinion of the International Searching Authority," issued in connection with International Application Serial No. PCT/IB2009/007436, mailed Mar. 29, 2010, 8 pages.

Intellectual Property Office, "Patents Act 1977: Search Report under Section 17," issued in connection with GB Application Serial No. GB0821364.7, completed Mar. 18, 2009 2 pages.

Kenyon et al., "High Capacity Real Time Broadcast Monitoring,", IEEE International Conference on Systems, Man and Cybernetics, Oct. 1991, 6 pages.

International Bureau, "Notification Concerning Transmittal of International Preliminary Report on Patentability", International Preliminary Report on Patentability, International Application No. PCT/IB2009/007436, Jun. 3, 2011 (8 pages).

* cited by examiner

*Primary Examiner* — Chris Parry
*Assistant Examiner* — Oschta Montoya
(74) *Attorney, Agent, or Firm* — Hanley, Flight & Zimmerman, LLC

(57) ABSTRACT

An audience measurement system generates signatures of unknown pieces of content viewed by panel members, and generates multiplexed reference signatures of known pieces of content. The signatures of the unknown pieces of content are stored and transmitted to a central processing site, where they are compared with the reference signatures for their identification. A signature comparator finds matches between the signatures of the unknown and the known contents.

24 Claims, 5 Drawing Sheets

AUDIENCE MEASUREMENT APPARATUS, SYSTEM AND METHOD

CROSS-REFERENCE TO RELATED APPLICATIONS

This application claims priority to British application GB0821364.7, filed Nov. 21, 2008, entitled AUDIENCE MEASUREMENT APPARATUS, SYSTEM AND METHOD which is incorporated herein by reference in its entirety for all purposes.

FIELD OF THE INVENTION

The present invention relates to an apparatus, system and method used for measuring the audience of a media presentation, in particular using content matching technologies.

BACKGROUND

Apparatuses and methods for measuring the audience of a media presentation, such as a television or a radio programme, are well-known in the industry. The knowledge of the size and composition of audiences to television or radio broadcasts transmitted to certain environments, like for example a home, is of paramount importance for the whole broadcast industry in order to rate the advertising space included in broadcasts.

A group of viewers cooperating in television audience surveys is called "panel", while each viewer participating in the panel is called a "panel member". An audience metering apparatus (called a "meter") is associated with each one of a plurality of media rendering devices or display systems used by panel members for watching television broadcasts at respective viewing locations. The metering apparatus has three main goals: a) determining the broadcast content being shown on the associated media rendering device; b) identifying the broadcast source and the distribution platform (e.g., a television channel transmitted over analogue terrestrial, digital terrestrial or analogue satellite platforms, or by means of cable TV, or IPTV, etc.); c) registering the presence of one or more panel members so that the exposure to the broadcast content and platform determined by the metering apparatus can be accounted to produce audience data.

Audience metering systems typically include a set-top box connected to the media rendering device (traditionally a television in the case of media which includes video). In order to identify the viewed broadcast content, these metering systems may use one or many different methods available, such as tuner frequency measurement, detection of embedded video or audio codes, Service Information, image feature recognition, watermarking, and signature generation, amongst others.

In the case of the latter, many systems have been proposed which, essentially, include metering devices that derive signatures continuously or discretely either from the audio or video output (or both simultaneously) of the television or display device, and store the signatures together with an associated time stamp. The stored signatures generated by the metering devices are later transmitted by means of a modem or any other telecommunications means to a remotely located central base, where they are processed in order to identify all broadcast content shown on the monitored television or display device.

This function may be achieved by means of content identification technology which comprises techniques and methods that can recognize an unknown segment of audio or video material among a plurality of reference signatures generated from known audio or video streams. Content identification therefore requires the generation and recognition of reference signatures (also called fingerprints) for the different broadcast sources being monitored. Audio and/or video signals of the broadcast sources are converted into reference signatures that univocally characterize the media content of those signals. A pattern correlation engine is then used to identify an unknown piece of broadcast content by comparing its signatures against the previously-generated reference signatures. The content on display is then determined by analyzing correlation values according to appropriate algorithms in order to provide a wide range of media measurement and monitoring services, of which the most widely used is "Broadcast Identification" (i.e. recognizing a channel being watched on a television).

In recent years the number of television channels available to the public has increased by an order of magnitude (hundreds of channels compared to tens of channels), mainly due to the digitalization of the content distribution platforms, and this trend is set to continue. This phenomenon poses technical, operational and economical challenges to content matching audience measurement systems, especially as the costs related to referencing hundreds or even thousands of channels become prohibitive in terms of space, labor, hardware and other running expenses associated to large scale data processing.

Different solutions have been implemented to lower the impact of the increasing number of references requested, all of them consisting in the inclusion of (or substitution by) a complementary measurement technology as, for example, watermarking, broadcast identification codes (when available), banner reading, etc. However, these technologies either face the same challenges as content matching, or cannot solve all the associated problems. Watermarking, i.e., the insertion of audio or video codes in the signal stream, requires the installation of one encoder for each channel at the broadcaster's premises. In this case, the number of encoders required grows in direct proportion to the number of channels to me measured. Broadcast identification codes are only available for measurement purposes in certain distribution platforms (subscription based satellite and cable services, IPTV) and are inaccessible in a standard format in free distribution platforms, such as open satellite and Digital Terrestrial television, for example. Banner recognition and other solutions based on screen information analysis are highly dependent on the receiving device characteristics, such as aspect ratio, definition, set-top box's on-screen menus, etc.

There is, therefore, a need to solve the cost and technical challenges faced by content matching technologies when the number of broadcast sources to be monitored and measured is a large number, e.g. in the hundreds or even thousands.

BRIEF SUMMARY OF THE INVENTION

The present invention is defined by the appendant claims.

An audience measurement system generates signatures of unknown pieces of broadcast content viewed by the panel members, and generates reference signatures of known pieces of content transmitted by known broadcast sources. The signatures of the unknown pieces of content are stored and transmitted to a central processing site, where they are compared with the reference signatures for their identification.

The signatures of the known pieces of content of known broadcast sources are generated by means of a multiplexing process.

Preferably, a signature comparator finds matches between the signatures of the unknown broadcast content and the signatures of the known contents of the known broadcast sources generated by means of said multiplexing process, and associates the unknown content to a known piece of content.

BRIEF DESCRIPTION OF THE DRAWINGS

The invention will now be described, by way of example only, by referring to the enclosed figures of drawing, wherein.

DETAILED DESCRIPTION OF THE INVENTION

In a typical audience measurement system based on content matching methods a reference system is used to generate signatures of the audio or video content of the broadcast content transmitted by a variety of broadcast sources, and to store them for the purpose of comparison with the signatures generated by the meters installed at the panel homes. A typical broadcast source can be, but is not limited to, a television channel or a radio station.

Figure 1A:
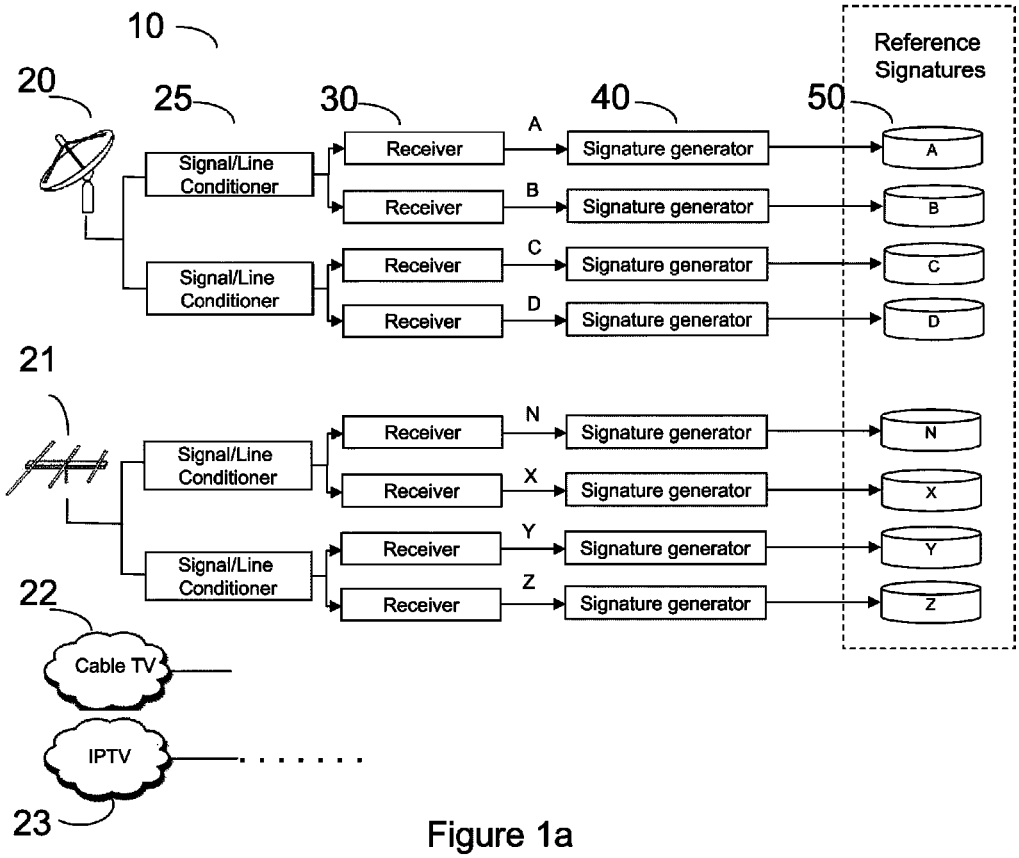
FIG. 1*a* is a diagram of a typical content matching reference system and its main components.

FIG. 1*a* shows the main components of a typical reference system 10. The signals of the broadcast sources to be monitored are received either by means of a satellite dish 20 (for analogue and digital satellite transmissions), a terrestrial antenna 21 (for analogue and digital terrestrial transmissions), a coaxial feed 22 (analogue and digital cable transmission), or a copper loop 23 (for ADSL based IPTV, for instance) or a fibre termination (used both by cable and IPTV operators), amongst the distribution platforms that are mostly used for the purpose of transmitting audio and video signals. The reference system includes all the different types of antennas or mechanical and electronics means needed to pick up the signals of the broadcast sources that are to be reported by the audience measurement service, said mechanical and electronics means being represented in the figure by signal and line conditioners 25 and receivers 30. Signal and line conditioners 25 may include low noise amplifiers, low noise block converters, RF and microwave filters, echo-cancellers, impedance adapters and crosstalk attenuators, among the most widely used. Receivers 30 may include local oscillators, analogue demodulators (e.g. Amplitude Modulation (AM), Single-side Band Modulation (SSB), Frequency Modulation (FM) and Phase Modulation), digital demodulators (e.g. Frequency-shift keying (FSK), Amplitude shift keying (ASK), Phase shift keying (PSK), Quadrature Amplitude Modulation (QAM), Minimum-shift keying (MSK), Continuous Phase Modulation (CPM) among Orthogonal frequency-division multiplexing (OFDM) among the most widely used), transport stream demultiplexers (e.g. the ones used in broadcast applications such as DVB and ATSC), channel decoders, decryption means, source decoders, digital to analogue converters, and any other electronics means needed to render an audio or video signal accessible to an end user device. Receivers 30 may include analogue audio and video outputs (such as, for example, composite video outputs, RGB outputs, component video outputs, or S-Video outputs), digital audio and video outputs (such as, for example, HDMI, DVI, DisplayPort, Apple's ADC and SDI), or any other type of ports and connectors available in the market.

In the case of analogue transmissions, for example, one tuner per channel is used to acquire a chosen audio and video signal. The tuner can be either a stand alone device, for commercial or professional use, or a board mounted on a rack configuration, or any piece of electronics able to extract audio and video content from an analogue electromagnetic signal. In the case of digital transmissions, one receiver including one demodulator and decoder is used per channel. The receiver can be either stand alone equipment, for commercial or professional use, or a board mounted on a rack configuration, or any piece of electronic equipment able to extract a selected signal from a digital data stream. FIG. 1*a* shows as an example four receivers 30 connected to two signal and line conditioners 25 (two receivers 30 per signal and line conditioner 25) that are connected to a satellite dish 20. A similar scheme is shown for the case of a terrestrial antenna 21. The received (tuned in the case of analogue transmissions and demodulated and decoded in the case of digital transmissions) signal is processed by a signature generator 40 which generates signatures (also called fingerprints in the prior art) 50 out of the audio or video part using one or more of a variety of algorithms well known to anyone skilled in the art. Each signature generator can be dedicated standalone equipment, a board mounted on a rack configuration or any piece of electronics circuitry suited for processing the signal and performing the signature generation algorithm. The corresponding reference signatures 50 are stored for later retrieval and comparison purposes.

As can be seen in FIG. 1*a*, even if the signal and line conditioners 25 can be shared among different receivers, a separate combination of one receiver 30 and one signature generator 40 is used to reference one signal of a broadcast source. Therefore, current reference systems need N receivers and N signature generators to reference N signals. The amount of line conditioners is directly proportional to the number N of receivers.

Figure 1B:
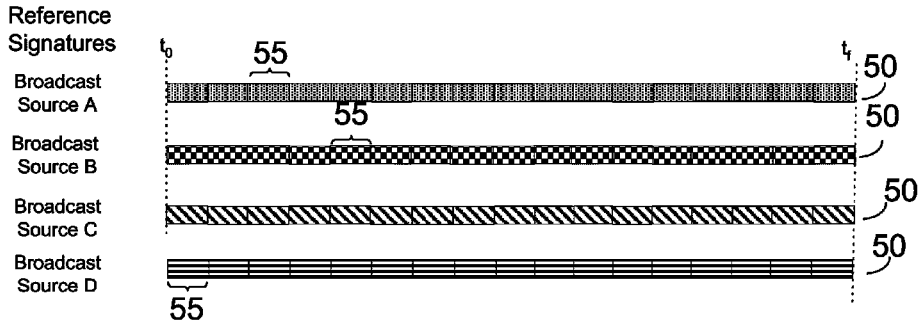
FIG. 1*b* is a graphical representation of reference signature segments generated by said typical content matching reference system.

Current content matching systems monitor and reference all required signals twenty-four hours a day, seven days a week, generating either continuous or discrete signatures. A set of consecutive signatures (continuous or discrete) will be referred to as a signature segment in what follows. FIG. 1*b* shows a graphical depiction of reference signature segments 55 of reference signatures 50 corresponding to four broadcast sources A, B, C and D, for a predefined period of time $t_0$-$t_f$. In the television audience measurement industry, for example, $t_0$ corresponds to 02:00:00 AM, and $t_f$ to 01:59:59 AM of the following day.

Figure 2:
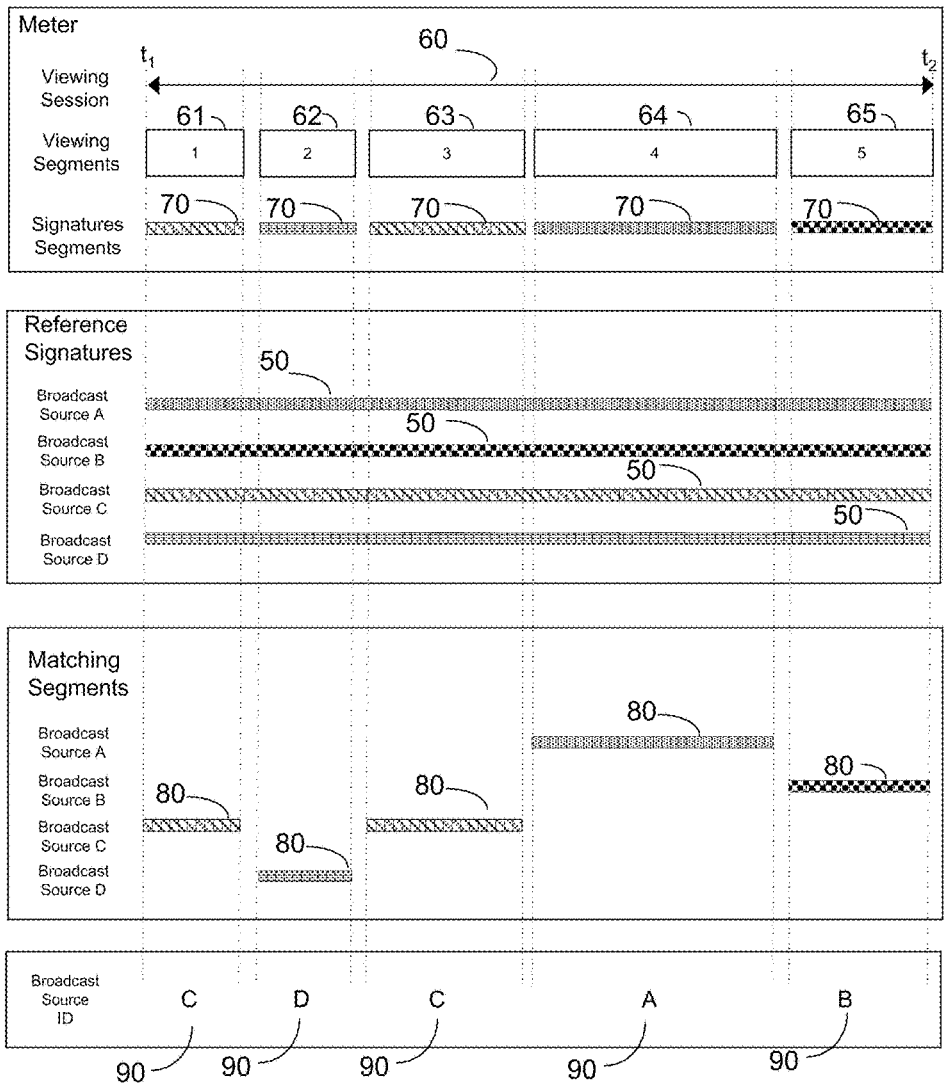
FIG. 2 is an illustration of a sequence of viewing segments detected by a meter and its corresponding signature segments; a stream of reference signatures to which the former are compared; the resulting matching segments; and the corresponding channel attribution.

In a typical audience measurement system, a monitoring apparatus is used to measure the viewing activity of one or more members of a randomly selected household with regards to a predefined media rendering device. A "viewing session" is defined as a period of time wherein the multimedia presenting device was on, and a panel member registered his or her presence. FIG. 2 shows a schematic diagram of a metered viewing session. In the example shown in FIG. 2 a viewing session 60 starting at a time t1 and ending at a time t2 is represented. Each viewing session, in turn, is divided into "viewing segments" (61, 62, 63, 64, 65 in the figure), i.e. a period of time wherein the same channel is watched or heard by the panel member.

In content matching systems, the meters generate signatures of the content present during the viewing segments, and the signatures segments 70 are then sent to a central processing site for identification purposes. The signatures segments 70 of the viewing segments are compared to the reference signatures 50, i.e., the signatures of all the possible broadcast sources that can be received by the monitored media device. For each broadcast source, therefore, a stream of signatures is stored in a file in the system's database. A matching engine compares the signatures segments 70 of the viewing segments with the reference signatures 50 of each broadcast source, and outputs the corresponding matches 80 which are used to identify the broadcast sources 90.

In existing content matching systems the broadcast sources are continuously monitored, and a dedicated receiver 30 and signature generator 40 (see FIG. 1*a*) is associated to each broadcast source at the reference system. In a system according to the present invention, at the reference system, one single receiver and one signature generator are used to generate reference signatures out of a number n of broadcast sources, based on time multiplexing techniques.

The period T of the multiplexing cycle is determined by the minimum time length $\tau$ of the signature segment that is required by the content matching system to match the signatures of the unknown piece of content with those of a known piece of content—and as a consequence identify the corresponding broadcast source—and by the number of broadcast sources to be multiplexed for referencing purposes. The value of T is calculated with the formula $T=n*\tau$.

Figure 3A:
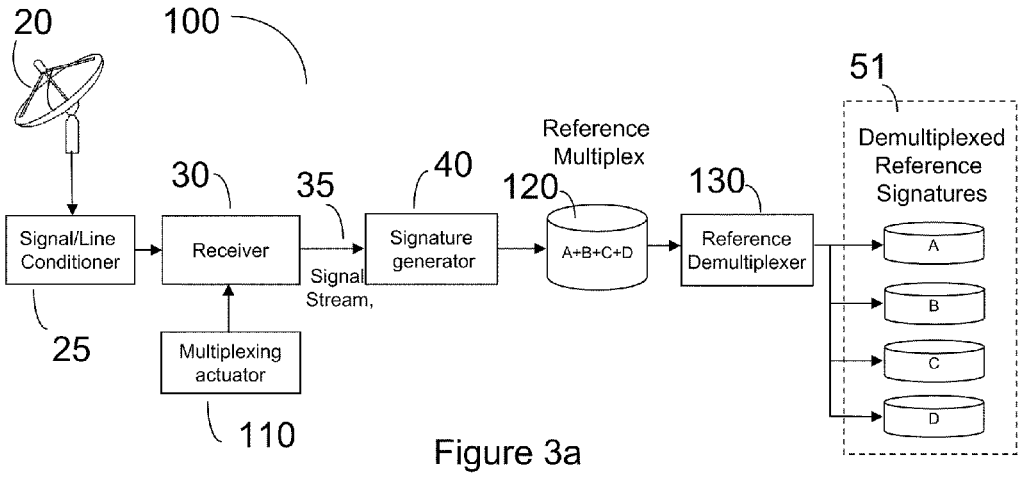
FIG. 3*a* is a diagram of an embodiment of a content matching reference system according to the present invention.

FIG. 3*a* shows a diagram of a reference apparatus 100 according to one embodiment of the present invention. For the sake of simplicity, the example is limited to a satellite broadcast transmission case but anyone skilled in the art would understand that the same concepts apply to all forms of digital and analogue signal transmission schemes. The apparatus 100 comprises an antenna 20 and its associated feeder connected to a signal receiver 30. The signal receiver 30 is controlled by means of a multiplexor 110 that instructs the signal receiver to tune or decode a signal $S_i$ (where i varies between 1 and n, the number of channels to be multiplexed for a single receiver) for a period of time $\tau$ before moving to the next signal. The multiplexor can be implemented by means of software running on the signal receiver, or by an external device connected to the signal receiver through a serial port, USB port, infra red port or any other type of data input/output means.

Figure 3B:
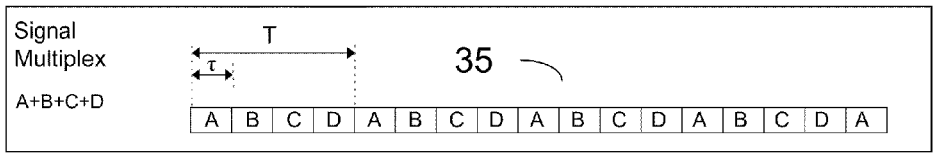
FIG. 3*b* is a graphical representation of a signal multiplex according to the system and method of the present invention

The multiplexed audio and video output of the signal receiver 30 is processed by the signature generator 40, which generates the signatures using any of the methods known in the state of the art. As a result of this process, a single reference multiplex 120 is created which includes signature segments belonging to n different broadcast sources. FIG. 3*b* shows an example of a reference multiplex 120 where n=4 (Broadcast sources A, B, C and D), and every period of time $\tau$ corresponds to the signature segment of a different broadcast source. The signature segments for any single broadcast source are present in the multiplex stream every period of time T (4 $\tau$ in the example).

Figure 3C:
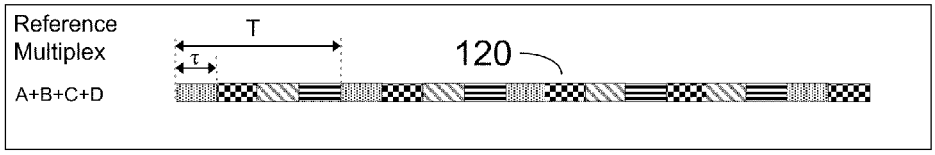
FIG. 3*c* is a graphical representation of multiplexed reference signatures according to the system and method of the present invention.
Figure 3D:
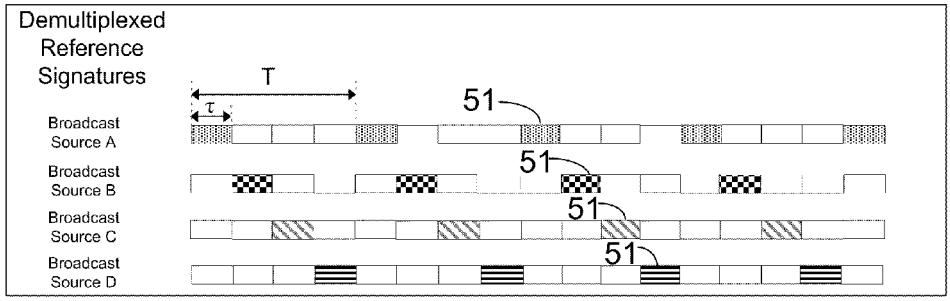
FIG. 3*d* depicts a representation of the demultiplexed reference signatures according to the system and method of the present invention.

The reference multiplex 120 is then processed by a reference demultiplexor 130 in order to obtain single demultiplexed reference signature segments 51 for each broadcast source. The reference demultiplexor 130 may be implemented by means of dedicated hardware, by means of a suitably programmed computer or by means of one or more software programmes running on a shared PC or server. The reference demultiplexor 130 is synchronized with the multiplexor 110 in order to correlate the time demultiplexing process with the original time multiplexing and to obtain the right signature segments for each broadcast source. FIG. 3*c* shows a graphical description of demultiplexed reference signatures corresponding to four broadcast sources A, B, C and D. As a result of the multiplexing/demultiplexing process, in the reference system of the present invention the reference signature segments for each broadcast source are not continuous, but available for matching purposes every period of time T for a time duration given by $\tau$.

Figure 4:
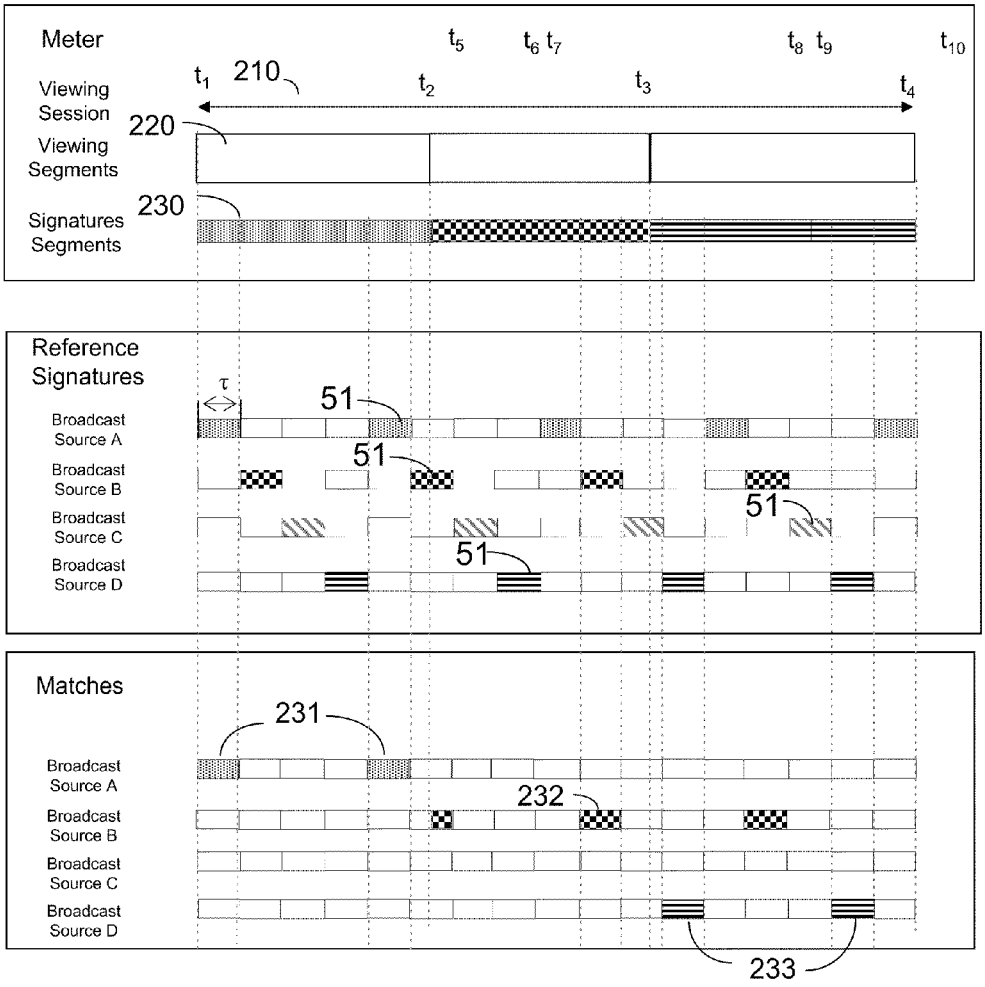
FIG. 4 is an illustration of a sequence of viewing segments detected by a meter and its corresponding signature segments; a stream of multiplexed reference signatures according to the present invention to which the former are compared and the resulting matching segments.

FIG. 4 shows a schematic description of the matching process of the system of the present invention. A viewing session 210 corresponding to a metered media device at a panel household is graphically depicted with three viewing segments 220, associated to three different broadcast sources, and the respective signature segments 230 generated during each viewing segment 220.

In the case of television broadcasts, for example, the minimum length of time that is considered by the audience measurement system as a viewing session is called in the industry "persistence threshold". In the past, meters based upon frequency measurement were able to identify channels changes with a one second precision, but the amount of data to be polled via low speed modems brought about long and expensive calls which led to both operational and economical inefficiencies. In this context a convention was agreed by the industry stakeholders by which channel changes would be reported only if the panel member(s) stayed for a minimum amount of time at the same channel. A value of fifteen seconds for the persistence threshold is generally used since then in television audience measurement systems in most countries. With the advent of digital television frequency meters were discarded and replaced with new measurement methods, including content matching systems. In the case of the latter, a minimum period of time is required by the system to identify an unknown piece of content by matching it with a known content. In the description of the present invention this minimum period of time has been called $\tau$.

In the example shown in FIG. 4, during the first viewing segment from $t_1$ to $t_2$ a signature comparator finds two full multiplexed signature segments 231 corresponding to broadcast source A. In the time period between $t_2$ and $t_3$, the second viewing segment, only one full match 232 is found (with channel B). Finally, the example shows that the signatures of the viewing segment between $t_3$ and $t_4$ match two full multiplexed signature segments 233 belonging to broadcast source D.

The method of the present invention is meant to solve the problem faced by content matching system when the number of broadcast sources to be referenced—in this case the broadcast sources are television channels—is counted by hundreds or thousands. In the case of television audience measurement, it is well known that in multi-channel scenarios the rating figures (i.e., the average percentage of a given population watching a TV channel/programme across a set time interval) for channels ranked after the hundredth position (or an even higher position in many countries) are equal or less than 0.1%. Because content matching systems are always used in association with panel based audience research, sampling errors must be taken into account. The sampling standard error SE for the rating value is given by the formula SE=sqr [r*(100−r)/s], where "r" is the channel rating and "s" the sample size. Assuming a value of 5,000 for "s" (a more than convenient number for most of the countries in which television audiences are measured), and the aforementioned rating value of 0.1 for a channel, the standard error for that rating will be SE=0.0447. According to sampling theory, this means that the value of the rating for that channel, with a confidence interval of 95%, will be between 0.0106 and 0.1894 (i.e., calculating the interval limits with the formula r±2SE). As can be seen, a channel with a TV rating of 0.1 is measured in a panel of 5,000 viewers with an error which can be as large as 89.4%. Such level of sampling error makes audience data for low-rated channels only useful if averaged over relatively long periods of time.

Moreover, any audience figure regarding audio or audio-visual broadcasts refers either explicitly or implicitly to a time period during which the measurement is performed. For example, a given rating figure of a television channel always refers to a minute of the day, or a total audience accumulated during a certain hour of the day, or month of the year, etc. Therefore, any audience measurement figure implies an accounting of the number of individuals reported as consuming a given broadcast during each elementary time period. Most audience measurement systems report viewing with a 1-minute resolution, which means that viewing segments shorter than 1 minute may not be reported, depending on given editing rules designed to attribute each minute of viewing. For example, in many audience measurement panels, each minute of viewing of each measured television set is attributed according to the channel reported by the metering system during one particular second of that minute (the middle second or the last second of the minute). This means that, regardless of the precision with which a metering system may capture tuning information, only one channel gets the viewing for each whole minute, according to how random variables play in determining the actual "winning channel" in each case.

In such context, the timing error produced in the determination of tuning for any given measured television set by the discontinuity of the reference signatures tends to produce no actual difference in the effective reporting of audiences to low-rated channels. It can be seen from FIG. 4 that, adopting an appropriate editing rule for minute attribution, any viewing segment longer than (n+1)*τ can be guaranteed to be always correctly credited. This is because segments of such length will, in all cases, be detected in one way or another by such system, even in the presence of multiplexed signature segments. The timing errors introduced by the same phenomenon can be seen to be of the same entity of errors already present in actual measurement systems by the fact of using one-minute resolution. Therefore, using a multiplexed referencing system as disclosed by the present invention with n=4 can produce significant savings without producing any significant detriment in the system's overall accuracy. The case of low-rated channels is even more compelling, given that the inevitable sampling errors tend to be much higher than any timing error introduced by multiplexed references.

A typical content matching system includes a back-up reference system. In an enhanced embodiment of the present invention, n is set to a value of 2 (two), and the backup multiplexed reference signature segments are generated with an offset equal to the value of τ with respect to the first set of multiplexed references. In this way, the overlap of both multiplexed reference signature segments gives as a result a continuous signatures stream, with the same performance of the non-multiplexed reference system.

Alternative Embodiment

Figure 5A:
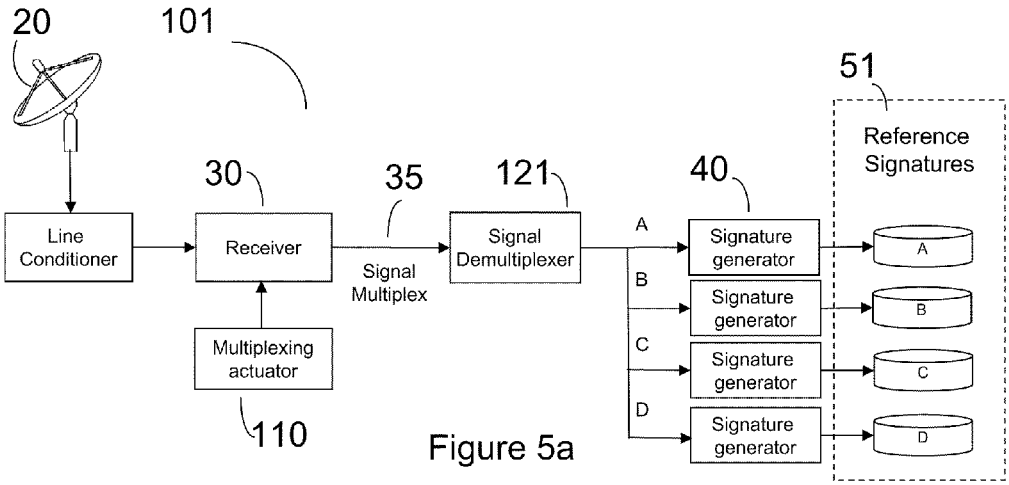
FIG. 5*a* is a diagram of another embodiment of a content matching reference system according to the present invention.
Figure 5B:
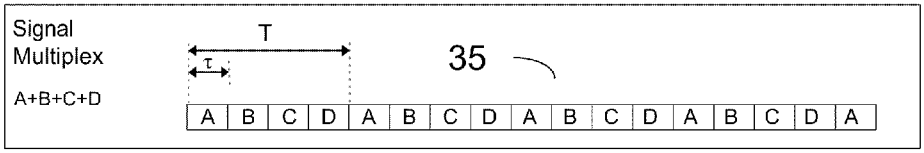
FIG. 5*b* is a graphical representation of a signal multiplex obtained by means of another embodiment of a referencing system and method according to the present invention.
Figure 5C:
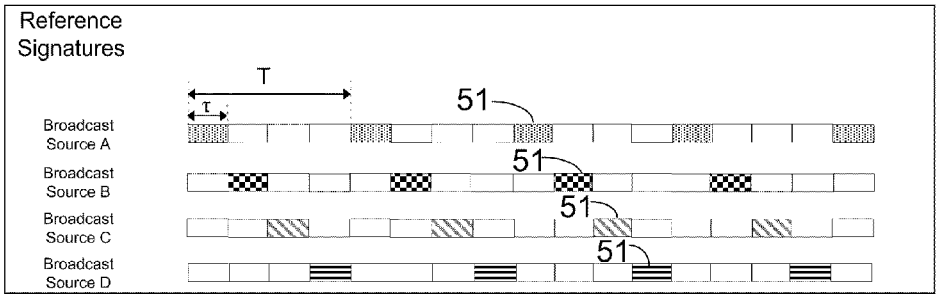
FIG. 5*c* depicts a representation of the reference signatures generated by means of another embodiment of a referencing system and method according to the present invention.

One embodiment of the present invention was shown in FIG. 3*a*, by which both the number of receivers (and the corresponding line conditioning devices) and the number of signature referencing units were reduced in order to reference large amounts of channels. It will be apparent to those skilled in the art that the multiplexing and demultiplexing tasks can be implemented at different stages of the whole referencing process. FIG. 5*a* shows a different embodiment of an apparatus 101 according to the present invention, in which the number of signature generators is equal to the number of channels N to be referenced because the demultiplexing task is performed at an earlier stage in the process. In this case, the output of the receiver 30, consisting of a multiplex stream 35 of n channels (n=4 in the example shown in FIG. 5*b*, corresponding to channels A, B, C and D) is not send to a signature generator, but processed by a stream demultiplexor 121 that separates the audio and/or video signals of each channel. The stream demultiplexor 121 can be either a standalone device, for commercial or professional use, or a board mounted on a rack configuration, a software programme running on a dedicated or shared computer, or any piece of electronics able to extract a single channel from a multiplex stream. The extracted audio and/or video signals are then processed by signature generators 40, which generate signature segments 51 (see FIG. 5*c*) with a similar format as the ones generated by the embodiment of the system shown in FIGS. 3*a*, 3*b* and 3*c*.

What is claimed as new and desired to be protected by Letters Patent of the United States is:

1. An apparatus for generating reference signatures, the apparatus comprising:

a first multiplexor to multiplex first signals received from a plurality of media sources at respective first intervals of time to generate a first multiplexed signal;

a first reference signature generator to generate a first reference multiplex of reference signatures from the first multiplexed signal;

a first demultiplexor to demultiplex the first reference multiplex to generate first reference signatures representative of media provided by the plurality of media sources during the respective first intervals of time;

a second multiplexor to multiplex second signals received from the plurality of media sources at respective second intervals of time to generate a second multiplexed signal;

a second reference signature generator to generate a second reference multiplex of reference signatures from the second multiplexed signal; and a second demultiplexor to demultiplex the second reference multiplex to generate second reference signatures representative of the media provided by the plurality of media sources during the respective second intervals of time, the respective second intervals of time being offset relative to the respective first intervals of time.

2. The apparatus of claim 1, further comprising: a memory in communication with the first demultiplexor to store the first reference signatures.

3. The apparatus of claim 1, wherein the first multiplexor is to interleave discrete segments of the first received signals in a time domain to generate the first multiplexed signal.

4. The apparatus of claim 1, wherein the first demultiplexor is to extract, in the time domain, the first reference signatures from the first reference multiplex into a respective sequence of first reference signatures for each one of the media sources, the first reference signatures comprising signatures corresponding to respective parts of the first received signals.

5. The apparatus of claim 1, wherein the plurality of media sources include a television channel.

6. The apparatus of claim 1, wherein the plurality of media sources include a radio station.

7. The apparatus of claim 1, wherein the first reference signatures are generated based upon time-domain features of the first received signals.

8. The apparatus of claim 1, wherein the first reference signatures are generated based upon frequency-domain features of the first received signal.

9. The apparatus of claim 1, wherein the first reference signatures are generated based upon digital data stream features of a digital signal.

10. The apparatus of claim 1, wherein the first multiplexor is implemented by software running on a signal receiver.

11. The apparatus of claim 1, wherein the first multiplexor is implemented by an external device connected to a signal receiver.

12. The apparatus of claim 1, wherein the first demultiplexor is implemented by dedicated hardware.

13. The apparatus of claim 1, wherein the first demultiplexor is implemented by a programmed processor.

14. The apparatus of claim 1, wherein the first demultiplexor is implemented by a software program running on a shared computer or server.

15. The apparatus of claim 1, wherein respective ones of the first intervals of time have durations substantially equal to a first duration, respective ones of the second intervals of time have durations substantially equal to the first duration, and the respective second intervals of time are offset relative to the respective first intervals of time by the first duration.

16. An audience measurement system for producing audience information of a media presentation, comprising:

the apparatus of claim 1;

a content signature generator to generate a signature from unknown media and send the signature to the apparatus;

a signature comparator to compare the signature of the unknown media with the first reference signatures, and determine if the signature of the unknown media matches any of the first reference signatures; and a processor to identify the unknown media based on a match found between the first reference signatures and the signature of the unknown media.

17. The system of claim 16, wherein the unknown media corresponds to live viewing.

18. The system of claim 16, wherein the unknown media corresponds to time-shifted viewing.

19. The system of claim 16, wherein the unknown media is a television program.

20. The system of claim 16, wherein the unknown media is a radio program.

21. The system of claim 16, wherein the unknown media is transmitted by an analog signal.

22. The system of claim 16, wherein the unknown media is transmitted by a digital signal.

23. A method for generating reference signatures, the method comprising:

multiplexing first received signals received from a plurality of media sources at respective first intervals of time to generate a first multiplexed signal;

generating a first reference multiplex of multiplexed signatures from the first multiplexed signal;

demultiplexing the first reference multiplex to generate first reference signatures representative of media provided by the plurality of media sources during the respective first intervals of time;

multiplexing second received signals received from the plurality of media sources at respective second intervals of time to generate a second multiplexed signal;

generating a second reference multiplex of multiplexed signatures from the second multiplexed signal; and demultiplexing the second reference multiplex to generate second reference signatures representative of the media provided by the plurality of media sources during the respective second intervals of time, the respective second intervals of time being offset relative to the respective first intervals of time.

24. The method of claim 23, wherein respective ones of the first intervals of time have durations substantially equal to a first duration, respective ones of the second intervals of time have durations substantially equal to the first duration, and the respective second intervals of time are offset relative to the respective first intervals of time by the first duration.

* * * * *